US009635894B2

(12) United States Patent
Breen et al.

(10) Patent No.: US 9,635,894 B2
(45) Date of Patent: May 2, 2017

(54) PINNY CLIP

(71) Applicants: Angeli Alino Breen, Summit, NJ (US); Griffin Michael Breen, Summit, NJ (US); Noah Frederick Breen, Summit, NJ (US)

(72) Inventors: Angeli Alino Breen, Summit, NJ (US); Griffin Michael Breen, Summit, NJ (US); Noah Frederick Breen, Summit, NJ (US)

( * ) Notice: Subject to any disclaimer, the term of this patent is extended or adjusted under 35 U.S.C. 154(b) by 400 days.

(21) Appl. No.: 14/202,369

(22) Filed: Mar. 10, 2014

(65) Prior Publication Data

US 2014/0259302 A1 Sep. 18, 2014

Related U.S. Application Data

(60) Provisional application No. 61/785,848, filed on Mar. 14, 2013.

(51) Int. Cl.
*A41F 19/00* (2006.01)
*A41F 15/02* (2006.01)

(52) U.S. Cl.
CPC ..... *A41F 15/02* (2013.01); *Y10T 24/3485* (2015.01); *Y10T 24/44658* (2015.01); *Y10T 24/44769* (2015.01)

(58) Field of Classification Search
CPC ..... A41F 15/02; Y10T 24/3485; Y10T 24/44658; Y10T 24/44769
USPC ..... 47/46
See application file for complete search history.

(56) References Cited

U.S. PATENT DOCUMENTS

| | | | | | |
|---|---|---|---|---|---|
| D33,094 | S | * | 8/1900 | Green | D11/212 |
| D34,899 | S | * | 8/1901 | Brockelbank | 24/581.12 |
| 1,401,227 | A | * | 12/1921 | Wyeth | A41F 15/02 2/323 |
| 3,432,129 | A | * | 3/1969 | Santucci | F16L 3/237 24/370 |
| D272,887 | S | * | 3/1984 | Parton | D8/382 |
| D292,385 | S | * | 10/1987 | Udelhofen | D11/210 |
| 4,979,714 | A | * | 12/1990 | Russell | A61M 5/1418 24/370 |
| 5,935,044 | A | * | 8/1999 | Brewster | A41F 15/02 24/545 |
| D583,706 | S | * | 12/2008 | Gilbert | D11/210 |
| 7,882,600 | B2 | * | 2/2011 | Judd | B65H 75/36 24/339 |
| D698,636 | S | * | 2/2014 | Weinberg | D8/356 |
| D702,105 | S | * | 4/2014 | Weinberg | D8/356 |
| 2010/0058516 | A1 | * | 3/2010 | Merriam-Smith | A41F 15/02 2/336 |

* cited by examiner

*Primary Examiner* — Robert J Sandy
(74) *Attorney, Agent, or Firm* — Kelley Drye & Warren LLP

(57) ABSTRACT

An apparatus for holding the straps or sleeves of a sports or group pinny (also called a scrimmage vest) from falling off the shoulders and thereby improving the fit of the garment and allowing the wearer better mobility. The apparatus secures a first and a second strap of a sports or group vest, the apparatus having a horizontal section and a pair of loops extending from the horizontal section. Each loop includes an aperture for receiving one of the shoulder straps of the sports or group pinny.

2 Claims, 5 Drawing Sheets

*-- PRIOR ART --*

*-- PRIOR ART --*

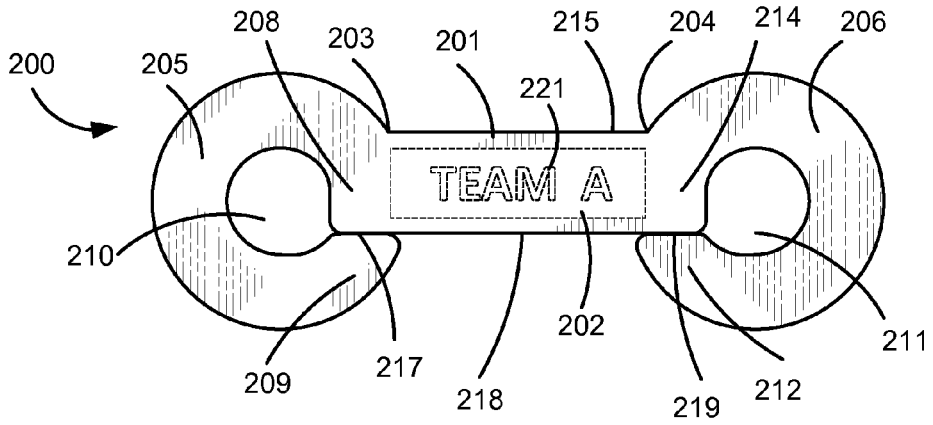
FIG. 2A
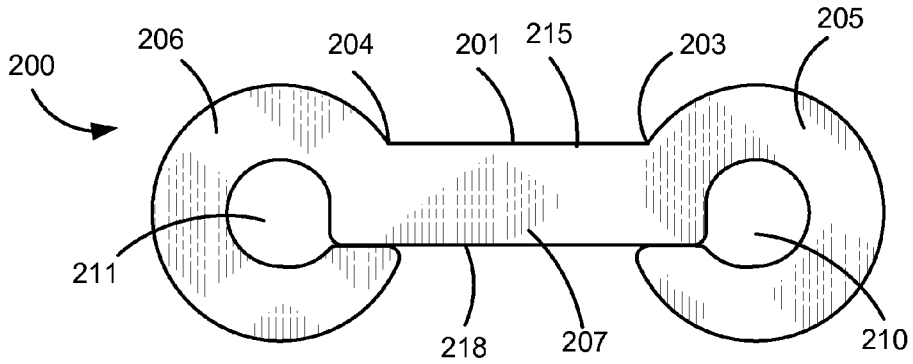
FIG. 2B
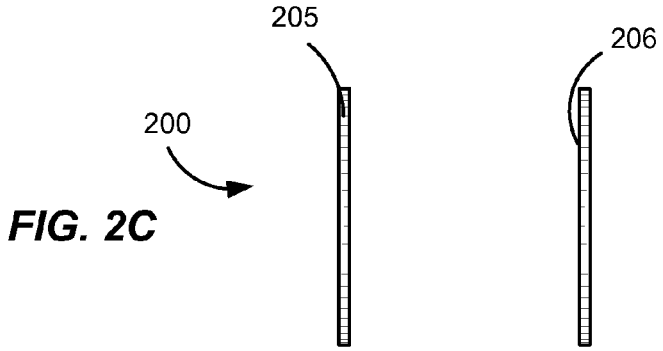
FIG. 2C
FIG. 2D
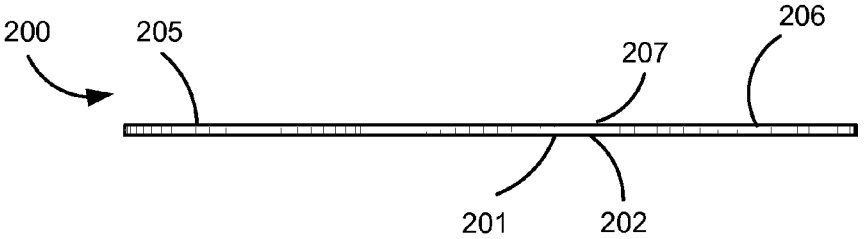
FIG. 2E
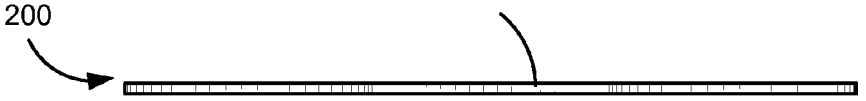
FIG. 2F

PINNY CLIP

CROSS-REFERENCE TO RELATED APPLICATION

This application claims the benefit of Provisional Application No. 61/785,848, filed Mar. 14, 2013, the entire contents of which are herein incorporated by reference.

FIELD OF THE INVENTION

The present invention relates to the field of sport apparel, and particularly, to an apparatus and method for securing the straps or sleeves of a sports or group pinny (also known as a scrimmage vest).

BACKGROUND OF THE INVENTION

A pinny is a sleeveless shirt made of a thin material that is worn over existing clothing. Some team sports normally utilize a pinny during games or practice. It is normally worn during a sporting activity where players are broken up into two opposing teams to scrimmage against each other. The pinnies are reversible, with a different color on each side to identify team members. As such, pinnies are typically offered in one size and are usually made to fit the larger participant in the group. However, average to small sized participants, even with the use of athletic shoulder pads, as is the case in lacrosse, find that the pinny straps fall off the shoulder across the upper arm and restricts arm movement.

When participating in sports or competitive activities, optimal performance is important. Since pinnies tend to be of one size for the team and since a team is comprised of different sized players, some players have to wear an ill fitting pinny. An ill fitting pinny is frustrating to wear. Players wearing ill fitting pinnies are constantly pulling up their pinny straps as they tend to fall down often during the activity. When a pinny strap falls down, it normally cuts across the arm and prevents the arm from moving easily or prevents full range motion of the arm. When a player is running down the field, the straps tend to fall and flap on the shoulders and it can be an annoyance and a distraction to the player.

In a game and practice situations when players are wearing team pinnies and the pinny does not fit properly, players, coaches and parents have made a number of on-field modifications. For example, as illustrated in FIG. 1A, one solution was to tape the back of the two straps 101 and 102 of pinny 100 together with athletic grip tape 104 to keep the straps from falling off the shoulders. While this alteration works in securing the pinny straps, thereby preventing the straps from falling on the shoulder, it is difficult to see the player's number 106 on the back of the pinny 100. The folds formed by the pinny 100 as a result of the taping obscure the player's number 106. The tape 104 has to be secured and removed by someone other than the player. Furthermore, the tape 104 looks messy and in order to take off the pinny 100, the grip tape 104 must be removed. The process of removing the tape is tedious, has to be removed by someone else, and results in a sticky pinny from the remaining residual tape adhesive, even after washing.

As another solution, as shown in FIG. 1B, the two straps 101 and 102 of pinny 100 are crisscrossed over the participant's head, thereby shortening the straps 101 and 102 to keep the pinny 100 from falling off the shoulders. This alteration requires the assistance from another person, like a coach or a parent. Coaches tend to use this method in the midst of a game when they notice a player is having difficulty with mobility because the pinny has slipped past their shoulders and a strap is restricting their arm movements. In sports that require a hat or a helmet, those items may need to be removed first in-order to crisscross the straps—which slows down the game. While this alteration method is somewhat effective in keeping the pinny straps on the shoulders, crisscrossing the straps of the pinny obscures the player's number 106 on the back of the pinny and any printing (normally the team name) on the front of the pinny (not shown). When a player's number 106 is obscured, it causes confusion among the players, coaches, referees and spectators.

In general, the above modifications are ineffective as a long term solution to the falling pinny straps. Both modifications have sloppy appearance and require adult assistance to make and remove the pinny modification. Further, both modifications obscure any printing on the back and/or front of the pinny, which usually includes the participants' numbers and the name of the organization or team.

Therefore, what is needed is an apparatus and method to secure the straps or sleeves of a sport or group pinny, which does not obscure any indicia on the pinny, and which can be easily put on and removed while staying secure during the intended activity.

SUMMARY OF THE INVENTION

An object of the present invention is to overcome the drawbacks of the previous inventions.

Another object of the invention is to solve the problem of poor fitting sports pinnies, also known as scrimmage vests.

Another object of the invention is to secure the straps or sleeves of a sport or group pinny.

Another object of the invention is to improve the fit of the pinny and thereby improving the appearance and mobility of the players.

Another object of the invention is to secure the straps or sleeves of a sport or group pinny while allowing the player's number and team name to be visible.

Another object of the invention is to improve player's mobility and thereby helping to improve the player's performance.

Another object of the invention is to provide a pinny clip that stays secure during sport activity, but which is easy to put on and remove.

Another object of the invention is to provide a pinny clip that can be customized.

In one embodiment of the invention, the apparatus comprises a clip for securing a first and a second strap of a sports or group vest, comprising: a horizontal section having a front surface and a rear surface extending from a first end to a second end; a first loop extending from a first end to a second free end and comprising a first aperture formed therethrough, wherein the first end of the first loop is connected to the first end of the horizontal section, wherein the first end and the second free end of the first loop are in proximity to each other and form a first gap therebetween; and a second loop extending from a first end to a second free end and comprising a second aperture formed therethrough, wherein the first end of the second loop is connected to the second end of the horizontal section, wherein the first end and the second free end of the second loop are in proximity to each other and form a second gap therebetween; wherein the first strap of the sports or group vest is inserted through the first gap and into the first aperture of the first loop, and wherein the second strap of the sports or group vest is inserted through the second gap and into the second aperture of the second loop.

BRIEF DESCRIPTION OF THE DRAWINGS

A further understanding of the invention can be obtained by reference to a preferred embodiment set forth in the illustrations of the accompanying drawings. Although the illustrated embodiment is merely exemplary of systems, methods, and apparati for carrying out the invention, both the organization and method of operation of the invention, in general, together with further objectives and advantages thereof, may be more easily understood by reference to the drawings and the following description. The drawings are not intended to limit the scope of this invention, which is set forth with particularity in the claims as appended hereto or as subsequently amended, but merely to clarify and exemplify the invention.

For a more complete understanding of the invention, reference is now made to the following drawings in which:

FIG. 2A is an elevational front view of a pinny clip according to the present invention;

FIG. 2B is an elevational rear view of the pinny clip of FIG. 2A;

FIG. 2C is an elevational left side view of the pinny clip of FIG. 2A;

FIG. 2D is an elevational right side view of the pinny clip of FIG. 2A;

FIG. 2E is a plan top view of the pinny clip of FIG. 2A;

FIG. 2F is a plan bottom view of the pinny clip of FIG. 2A;

DETAILED DESCRIPTION OF THE INVENTION

The invention may be understood more readily by reference to the following detailed description of a preferred embodiment of the invention. However, techniques, systems, and operating structures in accordance with the invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the invention. It must be noted that, as used in the specification and the appended claims, the singular forms "a", "an", and "the" include plural referents unless the context clearly indicates otherwise.

The present invention comprises an apparatus, and particularly, a pinny clip 200 illustrated in FIGS. 2A-2F, to secure the straps or sleeves of a sport or group pinny. The pinny clip can be used by boys, girls, men and women for any sport or activity where pinnies are used, whether in game or practice conditions. As such, pinny clip 200 may comprise various sizes, for example, a small size for children, a medium size for teens, and a large size for adults. Pinny clip 200 may be used in various activities, including, but not limited to, lacrosse, soccer, football, volleyball, ice hockey, field hockey, crew, rugby, ski racing, golf caddy, cross country, lifeguard, camp activities, fraternities and sororities, referee, intramural sports, other group games and events, corporate team building activities, and the like.

Figure 1A:
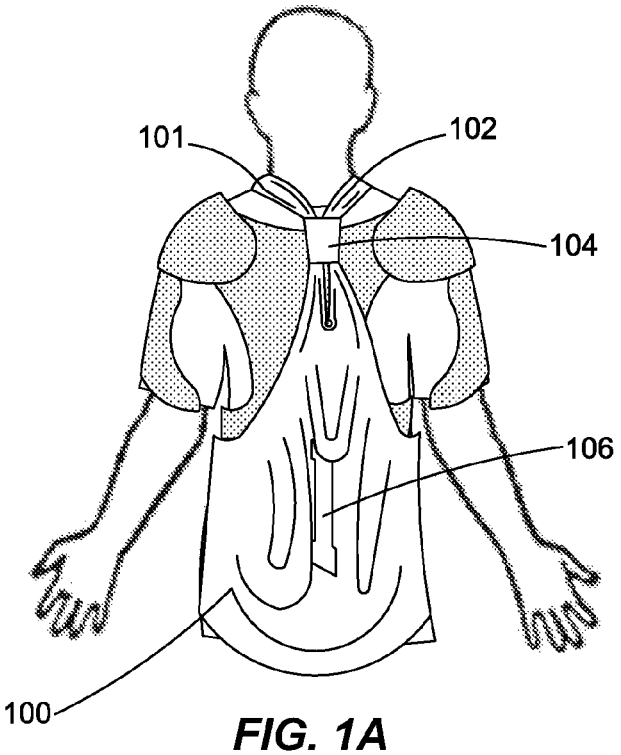
FIG. 1A is a back view of a prior art method of securing a pinny.
Figure 1B:
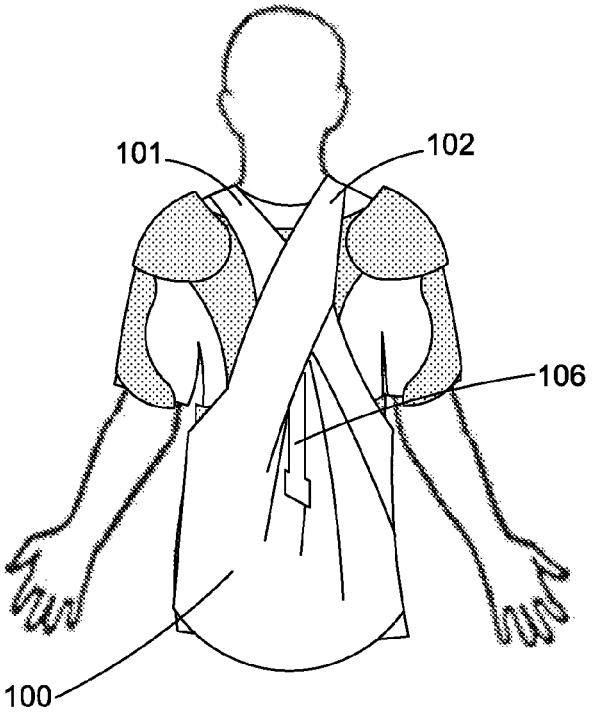
FIG. 1B is a back view of an alternative prior art method of securing a pinny.
Figure 3A:
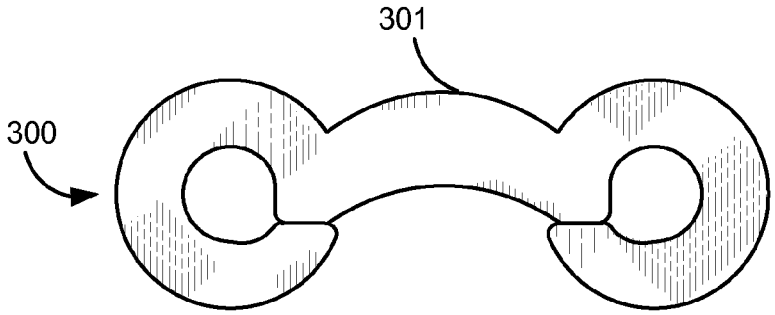
FIG. 3A is an elevational front view of a pinny clip according to an alternative embodiment of the present invention.
Figure 3B:
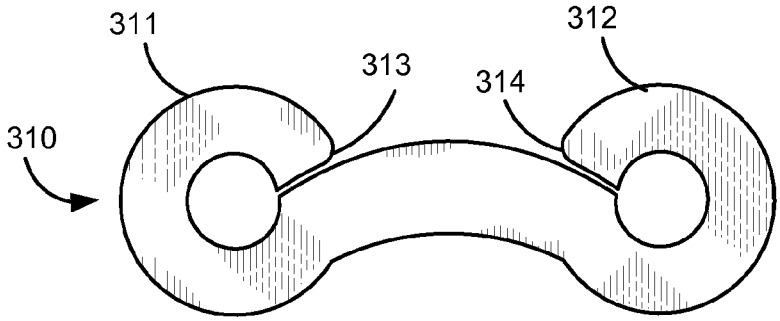
FIG. 3B is an elevational front view of a pinny clip according to another alternative embodiment of the present invention.

According to one embodiment, as illustrated in FIGS. 2A-2F, pinny clip 200 comprises a horizontal section 201 extending from a first end 203 to a second end 204. Horizontal section 201 may comprise a rectangular shape having a front surface 202 and a rear surface 207 extending between two parallel side walls 215 and 218. In an alternative embodiment, as illustrated in FIG. 3A, horizontal section 301 may comprise a curved shape. As shown in FIGS. 2A-2F, a pair of loops 205 and 206 extend from first and second ends 203 and 204 of the horizontal section 201. Loops 205 and 206 are preferably circular in shape. However, loops 205 and 206 can be designed in any shape, for example, semi-circles, squares, rectangles, ovals, triangles, diamonds, pentagon, hexagons, octagons, stars, hearts, flowers, or the like. Preferably, each loop 205 and 206 includes an aperture 210 and 211, respectively, located in its center. Apertures 210 and 211 are preferably shaped to correspond to the loop shapes. As such, apertures 210 and 211 are preferably circular. However, apertures 210 and 211 can be designed in any shape, for example, semi-circles, squares, rectangles, ovals, triangles, diamonds, pentagon, hexagons, octagons, stars, hearts, flowers, or the like. In a preferred embodiment, loop 205 extends from a first end 208, connected to the first end 203 of the horizontal section 201, to a second free end 209 (i.e., it is not connected to the horizontal section). Preferably, the second free end 209 is in proximity to the first end 208 of loop 205, forming a gap 217 therebetween. In one embodiment, the second free end 209 comes into a flush contact with the first end 208 of loop 205. Similarly, loop 206 extends from a first end 214, connected to the second end 204 of the horizontal section 201, to a second free end 212. Preferably, the second free end 212 is in proximity to the first end 214 of loop 206, forming a gap 219 therebetween. In one embodiment, the second free end 212 comes into a flush contact with the first end 214 of loop 206. Gaps 217 and 219 may be located at the bottom portion of loops 205 and 206. In an alternative embodiment, as shown in FIG. 3B, gaps 313 and 314 may be formed at the top portion of loops 311 and 312 of pinny clip 310.

Figure 3C:
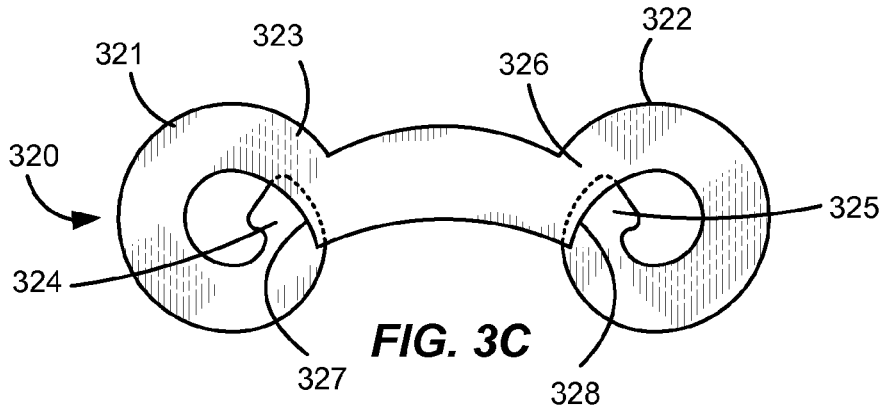
FIG. 3C is an elevational front view of a pinny clip according to another alternative embodiment of the present invention.
Figure 3D:
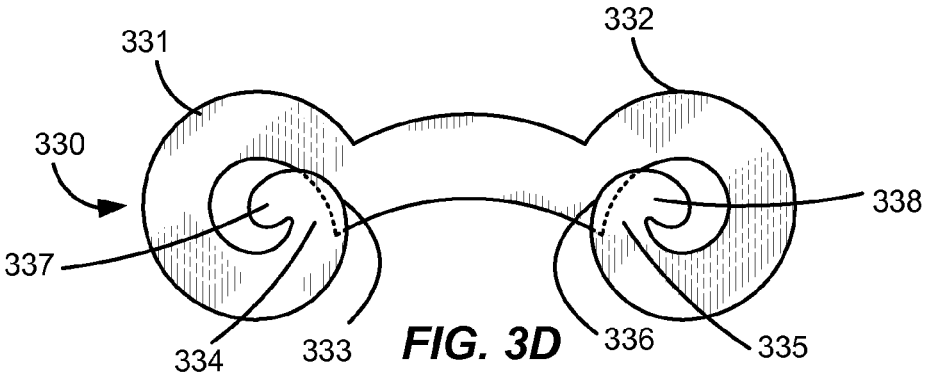
FIG. 3D is an elevational front view of a pinny clip according to another alternative embodiment of the present invention.

In another alternative embodiment, as shown in FIG. 3C, loops 321 and 322 may comprise a spiral design. As such, second free end 324 of loop 321 spirals towards first end 323 of loop 321, and slightly overlaps it, forming gap 327 therebetween. Similarly, second free end 325 of loop 322 spirals towards first end 326 of loop 322, and slightly overlaps it, forming gap 328 therebetween. In another embodiment, as shown in FIG. 3D, second free ends 334 and 335 of loops 331 and 332 further comprise hooks 337 and 338, respectively. The aforementioned configurations further ensure that pinny clips 320 and 330 hold the straps of the pinny together, as will be later described.

Pinny clip 200 may be made of rubber, plastic, cloth, or other flexible material. Pinny clip 200 may be manufactured by being cut out, molded, or extruded. Pinny clip 200 may comprise any color and may be made of a reflective material for better visibility thereof.

Figure 4A:
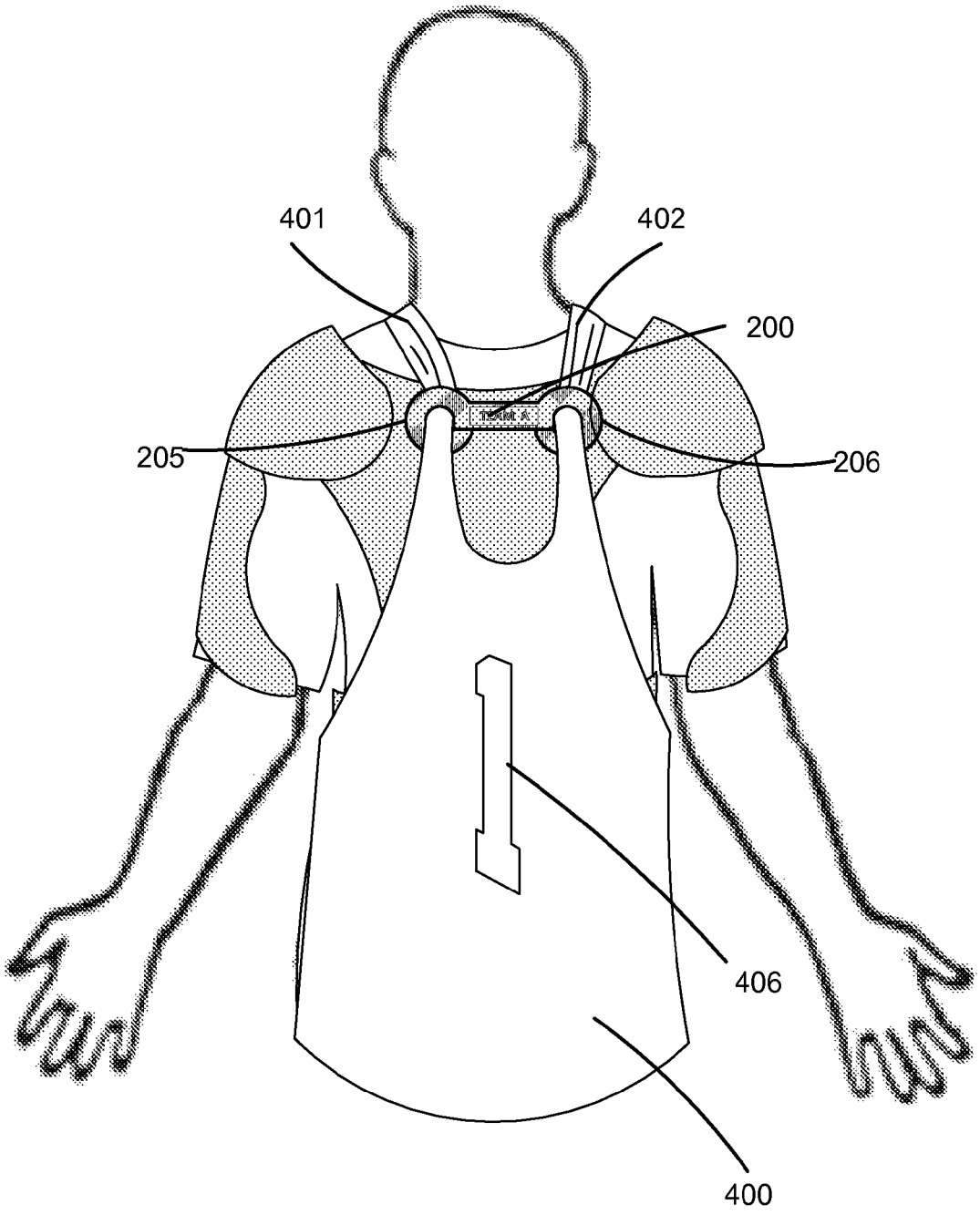
FIG. 4A is a back view of a pinny utilizing the pinny clip of the present invention.
Figure 4B:
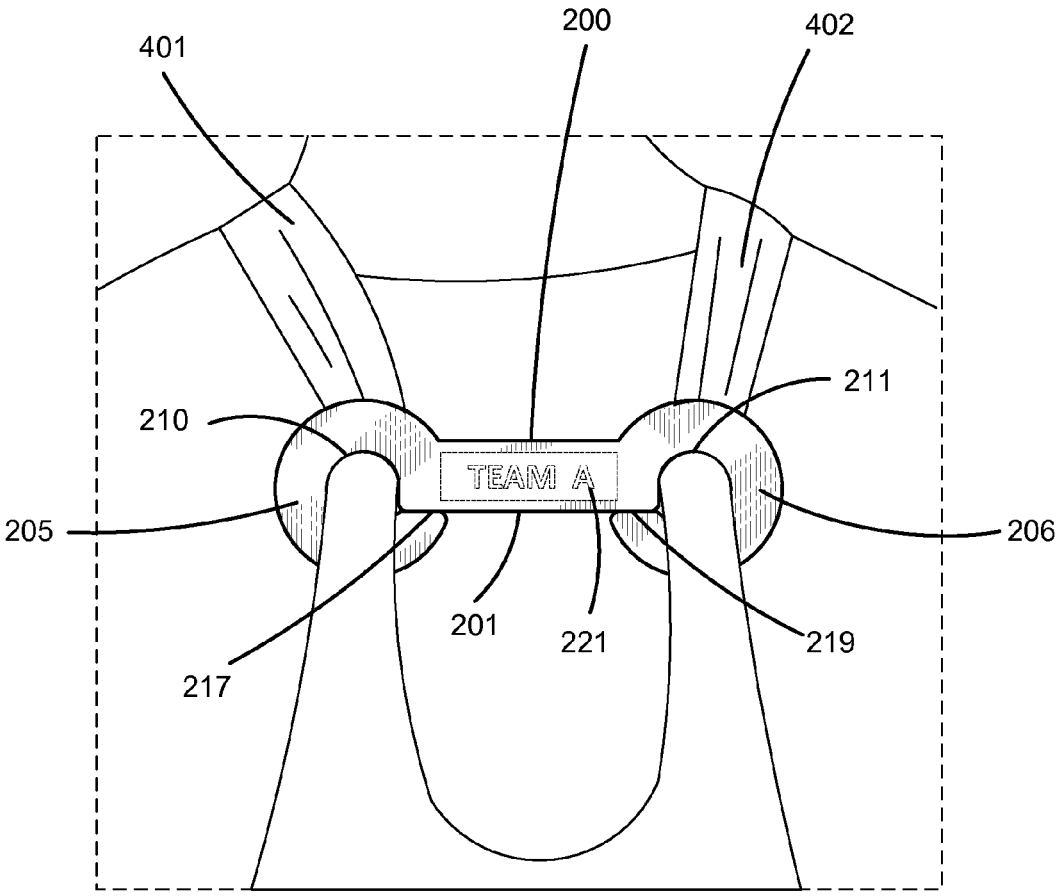
FIG. 4B is an enlarged back view of a pinny utilizing the pinny clip of the present invention.

As shown in FIGS. 4A-4B, pinny clip 200 is configured to hold the two straps 401 and 402 of pinny 400 together, thus preventing the straps 401 and 402, and thereby pinny 400, from falling off the shoulders of the wearer. To use the pinny clip 200, strap 401 is inserted through gap 217 into aperture 210 and strap 402 is inserted through gap 219 into aperture 211. Apertures 210 and 211 are preferably spaced apart at an optimal distance for the best fit. In a preferred embodiment, apertures 210 and 211 are preferably located three and a half inches apart. Apertures 210 and 211 hold straps 401 and 402 in place on each shoulder of the wearer so that the straps 401 and 402 do not fall off the shoulders and on to the arms of the wearer, which otherwise would impede arm mobility, limiting throwing, catching, blocking, shooting, running, twisting or other movements. The wearer of the pinny 400 can easily put on and remove pinny clip 200 without anyone's help. While pinny clip 200 can be easy put on and removed, the construction of the pinny clip 200 allows it to stay secure during the activity. Furthermore, pinny clip 200 allows the player's number 406 on the back of the pinny 400 and/or any other indicia on the pinny 400, such as team name, to be visible. Most importantly, the pinny clip 200 improves player's mobility and thereby helps to improve the player's performance.

As shown in FIGS. 2A and 4B, horizontal section 201 can be customized by printed, embossed, or embroidered indicia 221. Indicia 221 may include, but is not limited to, the name or symbol of the school, town, sponsor, team, camp, company, or motivational saying, cheer, pop culture reference or catch phrase, or the like. As such, customized pinny clips 200 can be used as incentives and as memorabilia for an event or organization.

It should be understood that this invention is not limited to the disclosed features and other similar method, system, and apparatus may be utilized without departing from the spirit and the scope of the invention.

While the invention has been described with reference to the preferred embodiment and alternative embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the invention is capable of being embodied in other forms without departing from its essential characteristics.

The invention claimed is:

1. An apparatus for securing a first and a second strap of a sports or group vest, comprising:

a horizontal section having a front surface and a rear surface extending from a first end to a second end;

a first loop extending clockwise from the first end of the horizontal section, the first loop comprising a first aperture formed therethrough for receiving the first strap of the sports or group vest; and a second loop extending counter-clockwise from the second end of the horizontal section, the second loop comprising a second aperture formed therethrough for receiving the second strap of sports or group vest;

wherein the first loop comprises a first attached end, connected to the first end of the horizontal section, and a first free end; and wherein the second loop comprises a second attached end, connected to the second end of the horizontal section, and a second free end; and wherein each of the second free end of the first loop and the second free end of the second loop comprises a hook.

2. A method for securing a first and a second strap of a sports or group vest, comprising:

providing a clip comprising:

a horizontal section having a front surface and a rear surface extending from a first end to a second end;

a first loop extending clockwise from a first end to a second free end and comprising a first aperture formed therethrough, wherein the first end of the first loop is connected to the first end of the horizontal section, wherein the first end and the second free end of the first loop are in proximity to each other and form a first gap therebetween; and a second loop extending counter-clockwise from a first end to a second free end and comprising a second aperture formed therethrough, wherein the first end of the second loop is connected to the second end of the horizontal section, wherein the first end and the second free end of the second loop are in proximity to each other and form a second gap therebetween; and inserting the first strap of the sports or group vest through the first gap and into the first aperture of the first loop; and inserting the second strap of the sports or group vest through the second gap and into the second aperture of the second loop.

* * * * *